US006331048B1

(12) United States Patent
Takizawa

(10) Patent No.: US 6,331,048 B1
(45) Date of Patent: Dec. 18, 2001

(54) INKJET PRINTHEAD HAVING MULTIPLE INK SUPPLY HOLES

(75) Inventor: Masahiro Takizawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/376,281

(22) Filed: Aug. 18, 1999

(30) Foreign Application Priority Data

Aug. 19, 1998 (JP) ..... 10-233214

(51) Int. Cl.[7] ..... B41J 2/05

(52) U.S. Cl. ..... 347/57; 347/59

(58) Field of Search ..... 347/19, 57–59, 347/7, 14, 65

(56) References Cited

U.S. PATENT DOCUMENTS 5,943,073 * 8/1999 Otsuka et al. ..... 347/57

* cited by examiner

*Primary Examiner*—John E. Barlow, Jr.
*Assistant Examiner*—Juanita Stephens
(74) *Attorney, Agent, or Firm*—Fitzpatrick, Cella, Harper & Scinto

(57) ABSTRACT

A printhead mainly includes at least two ink supply holes on a single semiconductor substrate, a first signal processing circuit laid out at at least one corner of the semiconductor substrate to arbitrarily select a heater for heating the ink, and a second signal processing circuit, other than the first signal processing circuit for arbitrarily selecting a heater, that realizes a function without dividing an arrangement. The lengths of signal lines are minimized to realize a printhead free from any malfunction.

14 Claims, 20 Drawing Sheets

INKJET PRINTHEAD HAVING MULTIPLE INK SUPPLY HOLES

BACKGROUND OF THE INVENTION

1. Field of the Invention

The present invention relates to a printhead for printing data on a printing medium by discharging ink in accordance with an inkjet printing method and, more particularly, to an inkjet printhead characterized by the layout of circuit blocks on the semiconductor substrate of the printhead having a plurality of electrothermal converters.

2. Description of the Related Art

A printhead mounted on a printing apparatus according to a conventional inkjet method has a circuit arrangement like the one shown in FIG. 4. The electrothermal converter (heater) of this printhead and its driving circuit are formed on a single substrate 400 by a semiconductor process technique, as disclosed in, e.g., Japanese Patent Laid-Open No. 5-185594. In FIG. 4, reference numerals 401 denote electrothermal converters (heaters) for generating heat energy; 402, power transistors each for supplying a desired current to a corresponding heater 401; 404, a shift register for supplying a current to each heater 401 and temporarily storing image data representing whether ink is to be discharged from the nozzle of the printhead; 405, a transfer clock (CLK) input terminal formed in the shift register 404; 406, an image data input terminal for inputting serial image data for turning on/off the heaters 401; 403, a latch circuit for latching image data for each heater in units of blocks; 407, a latch signal input terminal for inputting a latch timing signal (LT) to the latch circuit 403; 408, a block selection circuit (3-input 8-output decoder) for selecting a block; 409, 410, and 411, block selection circuit input logic signals, among which the signals 409 and 411 respectively correspond to the most and least significant bits; 419, a circuit for receiving a block selection output signal 416 and latch output signal 417 and outputting an AND; 413, a switch for determining a timing for flowing a current through the heater 401; 415, a heat signal input terminal (HEAT) for inputting a timing for controlling the switch 413; 414, a power supply line for applying a predetermined voltage and supplying a current to the heater; 412, a GND line which receives a current via the heater 401 and power transistor 402; 420, a circuit unit around the heater that includes the components 401, 402, 412, 414, 413, and 419; and 430, a unit which includes all the circuits 403, 404, 408, and 420 necessary for controlling discharge of one type of ink.

FIG. 7 shows an example of input and output waveforms to and from the block selection circuit 408 that is shown in FIG. 4. Reference numerals 409, 410, and 411 denote block selection input signals; 700 to 707, block selection output signals; and 710, a virtual timing signal which explains the timing, and takes values up to 7 such that it takes 0 for a period during which the block selection output signal 700 is at "Hi" level, and 1 for a period during which the block selection output signal 701 is at "Hi" level.

Operation of the shift register circuit 404 and latch circuit 403 that are shown in FIG. 4 will be described with reference to FIG. 8. FIG. 8 shows timings when the timing signal 710 has a value of 0. Also when the timing signal 710 has one of values of 1 to 7, signals are input at similar timings. Reference numeral 405 denotes a shift register transfer clock (CLK) signal; and 406, an image data input signal. The transfer clock input terminal 405 receives transfer clocks (CLK) by the number of bits of one block of image data stored in the shift register 404. Data is transferred to the shift register 404 in synchronism with the rise timing of the transfer clock (CLK). Image data (DATA) for turning on/off each heater 401 is input from the image data input terminal 406.

Image data stored in the shift register 404 will be called one image block. In this case, the number of heaters for one image block is eight, but can be arbitrarily set in practice. Transfer clock (CLK) pulses equal in number to the heaters 401 for one image block are input to transfer image data (DATA) to the shift register 404. Then, a latch signal (LT) is input to the latch signal input terminal 407 to latch image data corresponding to each heater in the latch circuit 403.

Referring back to FIG. 4, operation will be described again. Anyone of eight outputs 417 of the latch circuit 403 and anyone of eight outputs 416 of the decoder 408 are input to the AND circuit 419. When both the two inputs to the AND circuit 419 are at "Hi" level, a "Hi" signal is input to the switch 413. While the heat signal (HEAT) 415 for controlling the switch 413 is at "Hi" level, the switch 413 is kept on. By keeping the switch 413 on for a proper length of time by supplying the heat signal (HEAT) 415, a current flows into the power transistor 402 and heater 401 via the power supply line 414 during the ON period of the switch 413, and flows into the GND line 412. At this time, the heater 401 generates heat necessary for discharging ink, and ink corresponding to image data is discharged from the nozzle of the printhead.

The number of heaters which can be independently controlled by the latch circuit and decoder is determined by the product of the numbers of outputs 416 and 417, and in this case, 8×8=64 at maximum.

Reference numeral 502 denotes an ink supply hole formed at almost the center of the chip by anisotropy etching or sandblasting in order to supply ink from the rear surface of the semiconductor substrate. Inks that are supplied from the ink supply holes are supplied separately to the heaters 401 that are formed on the substrate 400 through ink passages (not shown). In accordance with the drive of the heaters, inks are supplied from orifices which are formed in the position corresponding to each heaters.

The unit 430 includes circuits necessary for discharging one type of ink that is supplied from the one ink supply hole. In FIG. 4, the circuit blocks 420 are laid out on the two sides of the ink supply hole 502. In this case, a total of 64 heaters are laid out on the two sides of the ink supply hole 502. The block selection circuit (decoder) 408, and the latch circuit 403 and shift register 404 are laid out on opposite sides via the transistor section 420. If they are laid out on the same side of the transistor section 420, the latch circuit 403, shift register 404, and decoder 408 have many elements, and the large area is required for arranging the units. Further, the latch circuit output line and decoder output line cross each other, which reduces the area and degrades reliability. Still further, the input terminals 405, 406, 407, 409, 410, and 411 must be arranged in a region on the same side of the substrate, which requires a large substrate size. For these reasons, the decoder 408, latch circuit 403, and shift register 404 are generally laid out as shown in FIG. 4.

FIG. 3 is a perspective view of the inkjet printhead which has circuit arrangement explained in FIG. 4 taken along the plane ABCD for descriptive convenience. The flow of ink will be explained with reference to FIG. 3.

An orifice plate 300 is mounted on the surface of the substrate 400, and a space for flowing ink, i.e., an ink passage 301 on the heater is defined in the orifice plate 300. An ink tank (not shown) is mounted on the lower surface of the semiconductor substrate 400, and from the lower surface side, the ink is supplied to the ink passage through the ink supply hole. Ink is guided onto each heater 401 via the ink passage 301. A current is flowed through the heater to apply heat to the ink, and ink droplets are discharged from an orifice 302, which is formed in the position corresponding to each heaters, in a direction perpendicular to the substrate plane by bubbles produced by boiling ink. Ink droplets 303 attach to a printing medium (not shown) such as a paper sheet placed parallel to the substrate plane to print data.

FIG. 5A is a block diagram showing the whole layout of a circuit that is not publicly disclosed, FIG. 5B is a block diagram showing a part A in FIG. 5A in detail, and FIG. 5C is a block diagram showing a part B in FIG. 5A in detail (to be simply referred to as "FIGS. 5A, 5B, and 5C").

The arrangement in FIGS. 5A, 5B, and 5C is obtained by simply laying out two arrangements in FIG. 4 side by side into one chip.

Reference numeral 501 denotes an ink supply hole for guiding, from the lower surface, ink different from ink of the ink supply hole 502; and 431, a unit which includes all circuits necessary for controlling discharge of one type of ink electrically similar to the block 430, and can control discharge/non-discharge of ink different from ink of the block 430 independently of the block 430.

The arrangement of FIGS. 5A, 5B, and 5C can determine the relative positions of heaters for controlling discharge of the ink of two colors by photolithography precision of the semiconductor process, and can attain a higher alignment precision than the case of laying out two arrangements in FIG. 4 side by side. A region near the cut surface must be set as an ineffective region where no element is formed because even slight chippings are generated upon cutting off a chip from a wafer. Thus, the arrangement in FIGS. 5A, 5B, and 5C requires only a smaller area than that twice the arrangement of the each unit in FIG. 4.

FIG. 6A is a block diagram showing the whole layout of a circuit that is not publicly disclosed, FIG. 6B is a block diagram showing a part A in FIG. 6A in detail, and FIG. 6C is a block diagram showing a part B in FIG. 6A in detail (to be simply referred to as "FIGS. 6A, 6B, and 6C").

The arrangement shown in FIGS. 6A, 6B, and 6C is obtained by adding functional units 601, 602, 603, 604, 605, and 606, other than a circuit for selecting a heater, to the arrangement shown in FIGS. 5A, 5B, and 5C. The circuit units 601, 602, and 603 are laid out by dividing one functional unit into three parts under limitations on a free layout region. Similarly, the circuit units 604, 605, and 606 are laid out by dividing one functional unit into three parts. An example of the functional unit is a circuit for correcting variations in heater resistance caused by variations in heater manufacturing process, e.g., variations in the film quality and film thickness of a heater material, photolithography, and etching.

The heater resistance variation correction circuit in FIGS. 6A, 6B, and 6C is constituted by a circuit 801 for detecting a heater value, a memory 802 storing the detection result, and a correction circuit 803 for making energy applied to ink uniform by changing the time for flowing a current through the heater in accordance with the value read out from the memory. The circuit 801 is formed from the same conductive film as the heater, and when the resistance of the heater varies, the resistance of the circuit 801 also varies. A voltage at the detection terminal 811 is externally read out by flowing a current through a detection terminal 811 connected to the circuit 801. The calculation result of variations in heater resistance from the voltage of the detection terminal 811 is written in the memory 802 via a data terminal 812 and write permission terminal 813. The memory 802 is a non-volatile memory which holds the memory contents even after the power supply is turned off. The multiplexer 803 selects arbitrary one of signals 815, 816, 817, and 818 on the basis of the contents of memory outputs 820, 821, 822, and 823, and controls the switch 413 by a selected heat signal (HEAT) 830 or 831. The signals 815, 816, 817, and 818 have different pulse widths. For example, a heat signal having a small pulse width is selected for a heater having a low heater resistance because this heater flows a large current and generates a larger power in a unit time than the remaining heaters. To the contrary, a heat signal having a large pulse width is selected for a heater having a high heater resistance. In this way, the heat generation amount of the heater is controlled to be uniform in any manufacturing lot.

In the prior art, however, when a signal processing circuit other than the heater selection circuit for selecting any electrothermal converter is to be arranged, the signal processing circuit unit like an adding functional unit must be divisionally laid out into several parts because the layout region is distributed. Wiring for connecting divided units must be prolonged to transfer a signal. Compared to one unit without any division, the wiring region, substrate size, and cost increase are problems encountered.

The inkjet printer must handle a large current through the heater 401 in order to realize reliable ink discharge. This current flows into the GND 412, generating a large GND line noise. To present this, a circuit arrangement resistant to noise is demanded. When the signal processing circuit unit is divisionally laid out into several parts, a critical signal line such as an analog signal line or high-speed digital signal line susceptible to disturbance must be bypassed over the unit in some cases. If switching noise is induced from the power supply line 414 or GND 412 to a signal line susceptible to disturbance, the circuits may malfunction, which is another problem.

If the signal processing circuit unit includes an analog circuit, the temperature difference between elements within the unit, and characteristic of the element by the influence of the production process variations are increased by dividing the signal processing circuit unit into several parts. Different element operating points requiring relative precision cause a negligible offset in terms of characteristics, and the characteristics of the signal processing circuit unit degrade, which is another problem.

SUMMARY OF THE INVENTION

It is the first object of the present invention to realize a low-cost printhead by reducing the substrate size by eliminating ineffective regions formed by divisional layout of a signal processing circuit unit like a adding functional unit. It is the second object of the present invention to realize a printhead free from any malfunction by minimizing the length of signal lines susceptible to disturbance. It is the third object of the present invention to realize a printhead having excellent characteristics by reducing the temperature difference and difference in characteristic of the element by the influence of the production process variations within a single signal processing circuit unit.

To achieve the above objects, an inkjet printhead according to the present invention has the following arrangement.

That is, an inkjet printhead which discharges ink and implements a recording comprises a substrate as an element, the substrate having a plurality of ink supply holes for passing the discharged ink, a plurality of heaters arranged in the vicinity of the ink supply holes for discharging ink that is supplied from the ink supply holes by heating, a first signal processing circuit laid out, at least, in one corner of the substrate to arbitrarily select and drive the heaters, and a second signal processing circuit other than the first signal processing circuit to arbitrarily select and drive the heaters.

A printing apparatus comprises the inkjet printhead, and a carriage to installed the inkjet printhead.

In the inkjet printhead according to a preferable aspect of the present invention, the second signal processing circuit has a control circuit arrangement laid out in a region which is interposed between the first signal processing circuits or adjacent to the first signal processing circuit.

In the inkjet printhead according to another preferable aspect of the present invention, the first signal processing circuit is made up of a shift register circuit and latch circuit.

In the inkjet printhead according to still another preferable aspect of the present invention, the first signal processing circuit includes a decoder circuit.

In the inkjet printhead according to still another preferable aspect of the present invention, the first signal processing circuit includes a buffer circuit.

In the inkjet printhead according to still another preferable aspect of the present invention, a signal processing circuit is laid out inside the first signal processing circuit.

In the inkjet printhead according to still another preferable aspect of the present invention, a control circuit for controlling the inkjet printhead is laid out inside the first signal processing circuit.

In the inkjet printhead according to still another preferable aspect of the present invention, the second signal processing circuit detects manufacturing variations.

In the inkjet printhead according to still another preferable aspect of the present invention, the second signal processing circuit predicts or detects a temperature of the printhead or a printing apparatus.

In the inkjet printhead according to still another preferable aspect of the present invention, the second signal processing circuit predicts or detects the type of ink or characteristics of ink.

In the inkjet printhead according to still another preferable aspect of the present invention, the second signal processing circuit predicts or detects residual ink amount.

In the inkjet printhead according to still another preferable aspect of the present invention, the second signal processing circuit predicts or detects exchange time of the printhead.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention, and together with the description, serve to explain the principles of the invention.

DETAILED DESCRIPTION OF THE PREFERRED EMBODIMENT

Preferred embodiments of the present invention will be described in detail in accordance with the accompanying drawings.

<General Description of Apparatus Main Body>

Figure 9:
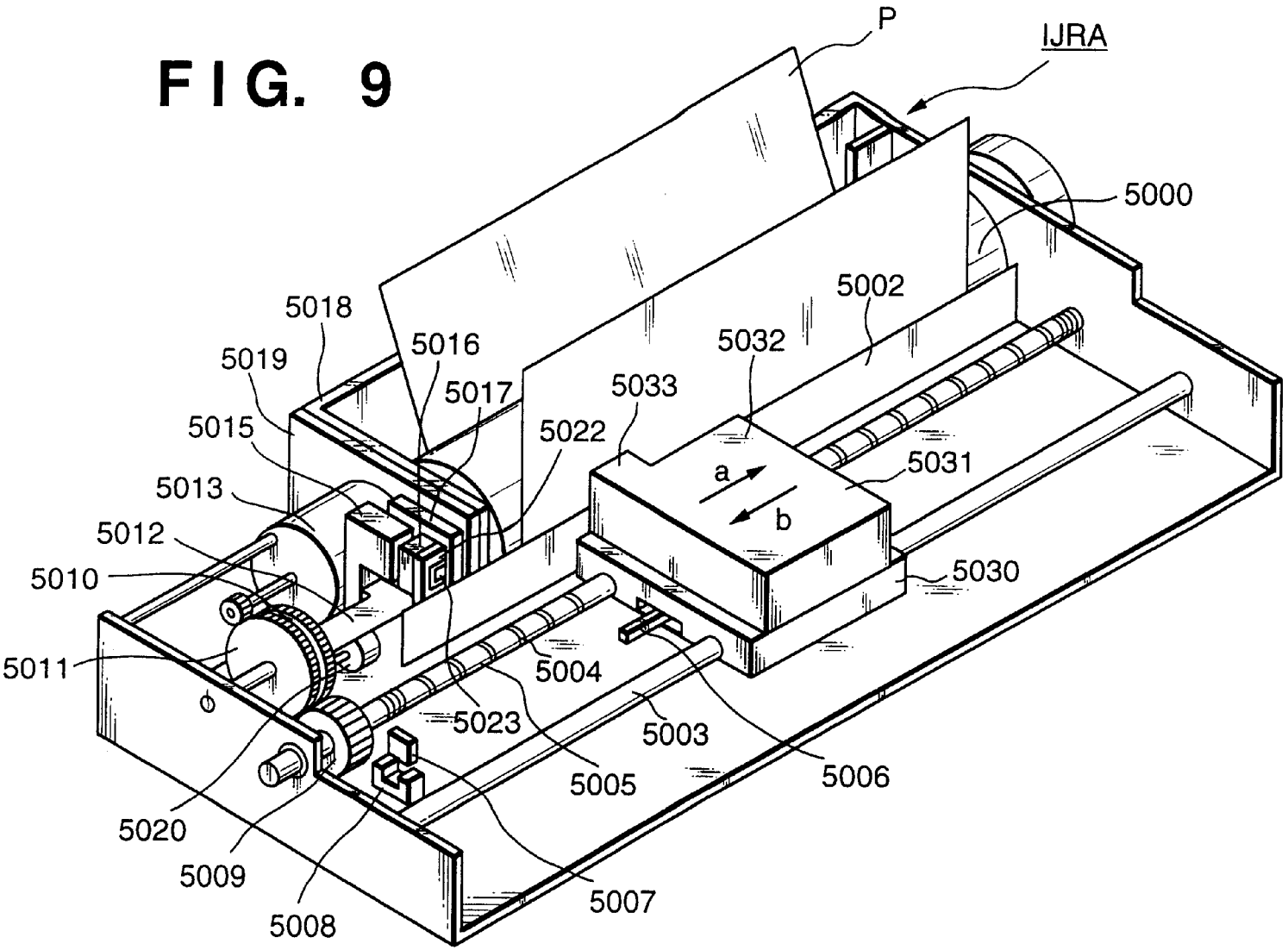
FIG. 9 is a perspective view schematically showing the outer appearance of an inkjet printer IJRA according to a representative embodiment of the present invention.

FIG. 9 is a perspective view schematically showing the outer appearance of an inkjet printer IJRA according to a representative embodiment to which an inkjet printhead of the present invention is applied. In FIG. 9, a pin (not shown) is attached to a carriage HC engaging with a helical groove 5004 of a lead screw 5005 which rotates via driving force transfer gears 5009 to 5011 while interlocking with forward/reverse rotation of a driving motor 5013. The carriage HC is supported by a guide rail 5003 to reciprocate in the directions of arrows a and b. An integral ink cartridge IJC incorporating a printhead IJH and ink tank IT is mounted on the carriage HC. Reference numeral 5002 denotes a sheet press plate for pressing a printing sheet P against a platen 5000 in the moving direction of the carriage HC; 5007 and 5008, photocouplers serving as home position detectors for detecting the presence of a carriage lever 5006 in a corresponding region and switching the rotational direction of the motor 5013; 5016, a member for supporting a cap 5022 which caps the front end of the printhead IJH; 5015, a suction unit which evacuates the interior of the cap and performs suction recovery of the printhead via an intra-cap opening 5023; 5017, a cleaning blade; and 5019, a member capable of moving this blade back and forth. The cleaning blade 5017 and member 5019 are supported by a main body support plate 5018. The blade is not limited to this, and a known cleaning blade can be applied to the present invention. Reference numeral 5021 denotes a lever which starts suction for suction recovery, and moves along with movement of a cam 5020 engaging the carriage. A driving force from the driving motor is controlled for movement by a known transmission mechanism such as a clutch switching mechanism.

Capping, cleaning, and suction recovery are executed by desired processes at corresponding positions by operation of the lead screw 5005 when the carriage comes to the home-position region. However, any processes can be applied to the present invention so long as desired operations are done at known timings.

<Description of Control Configuration>

A control configuration for executing printing control of the above apparatus will be described.

Figure 10:
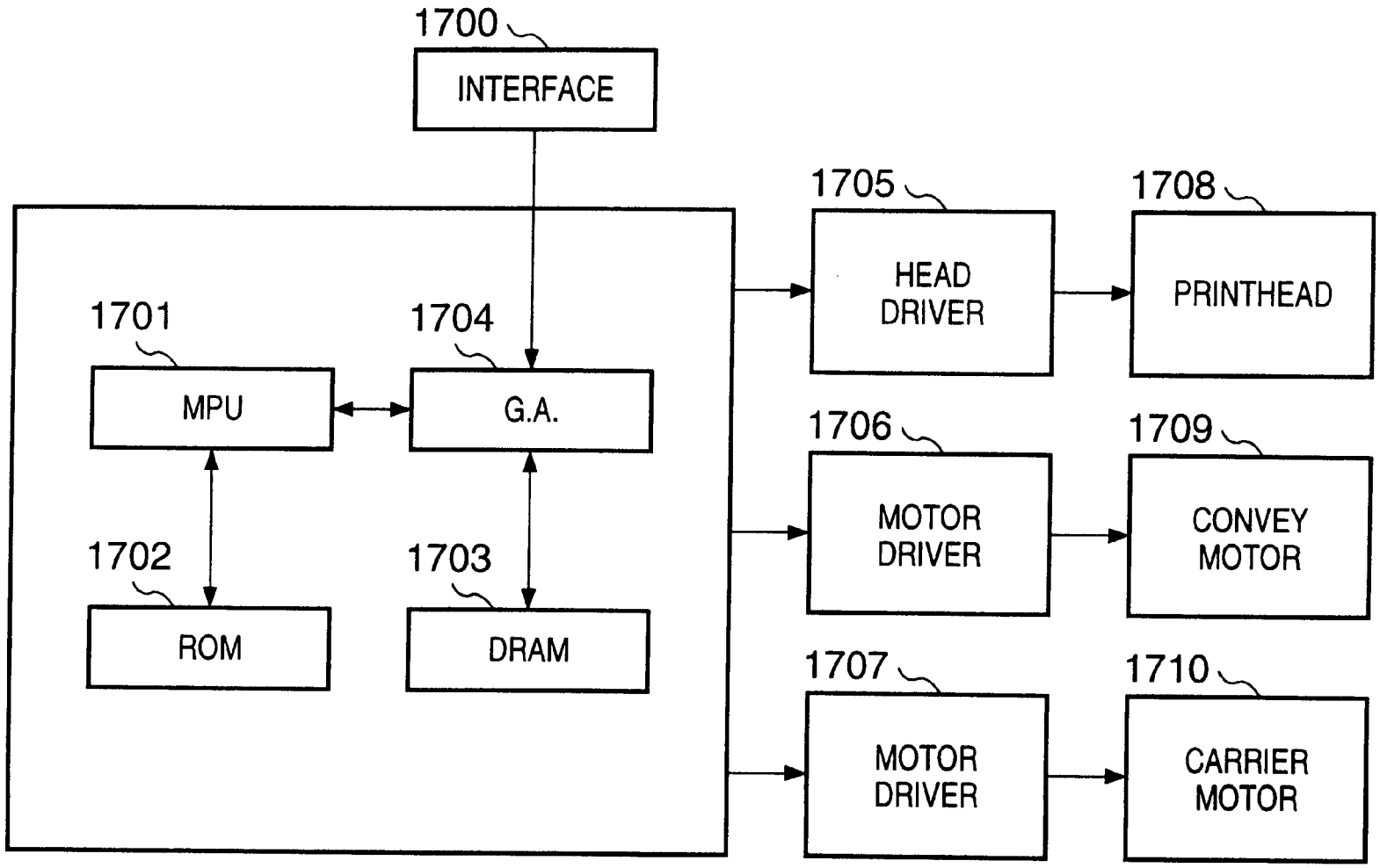
FIG. 10 is a block diagram showing the arrangement of a control circuit for the inkjet printer IJRA.

FIG. 10 is a block diagram showing the arrangement of a control circuit for the inkjet printer IJRA. In FIG. 10 showing the control circuit, reference numeral 1700 denotes an interface for inputting a printing signal; 1701, an MPU; 1702, a ROM storing a control program executed by the MPU 1701; 1703, a DRAM storing various data (the printing signal, printing data supplied to the head, and the like); 1704, a gate array (G.A.) which controls supply of printing data to a printhead 1708, and also controls data transfer between the interface 1700, MPU 1701, and DRAM 1703; 1710, a carrier motor for carrying the printhead 1708; 1709, a convey motor for conveying a printing sheet; 1705, a head driver for driving the printhead; and 1706 and 1707, motor drivers for respectively driving the convey motor 1709 and carrier motor 1710.

Operation of this control configuration will be explained. When a printing signal is input to the interface 1700, the printing signal is converted into printing data between the gate array 1704 and MPU 1701. Then, the motor drivers 1706 and 1707 are driven, and the printhead is driven in accordance with the printing data sent to the head driver 1705 to print the data.

Several embodiments of the printhead mounted on the inkjet printer IJRA having the above arrangement will be described.

[First Embodiment]

Figure 1A:
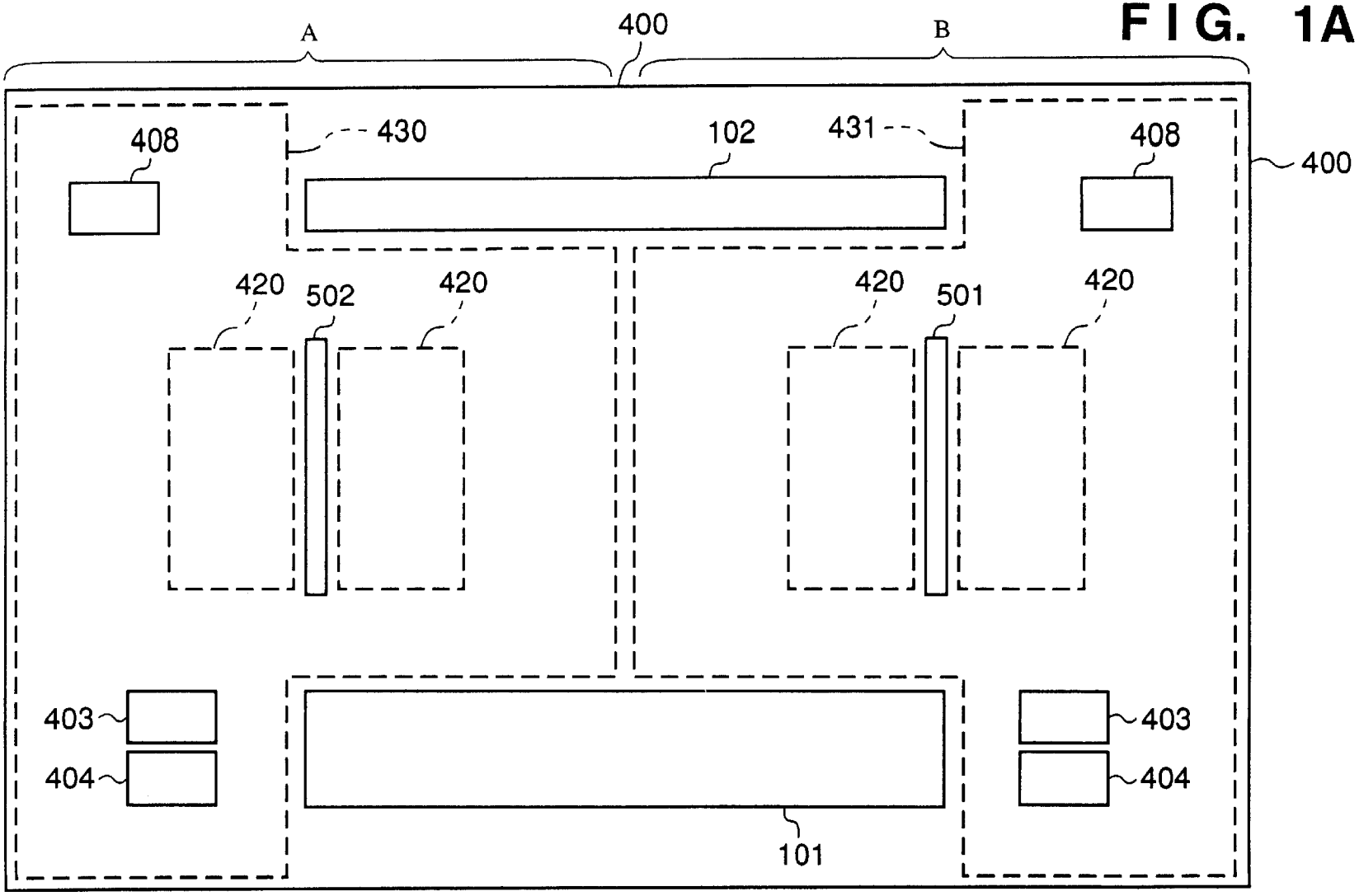
FIG. 1A is a block diagram showing the whole circuit arrangement according to the first embodiment.
Figure 1B:
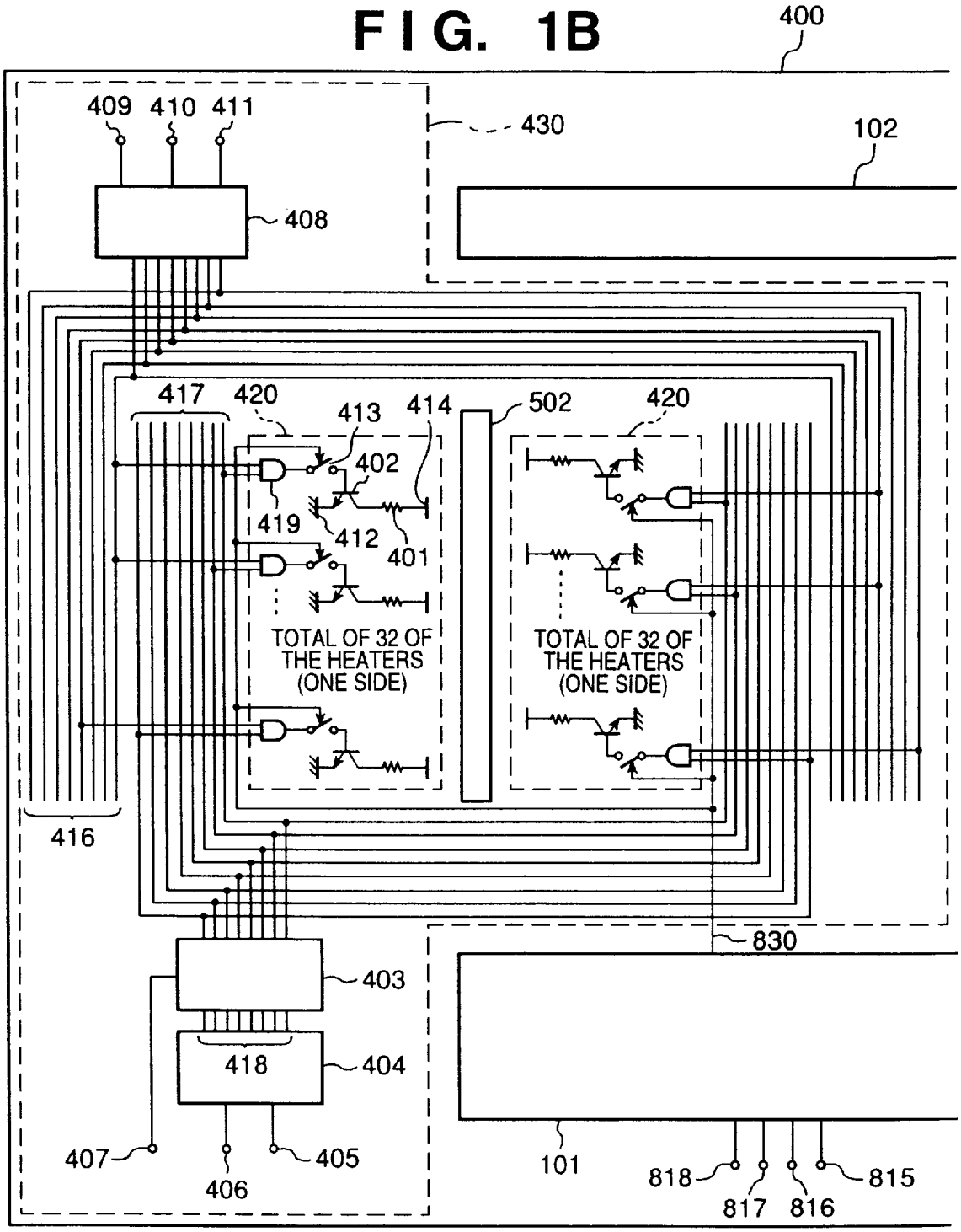
FIG. 1B is a block diagram showing a part A of the circuit arrangement according to the first embodiment in FIG. 1A in detail.
Figure 1C:
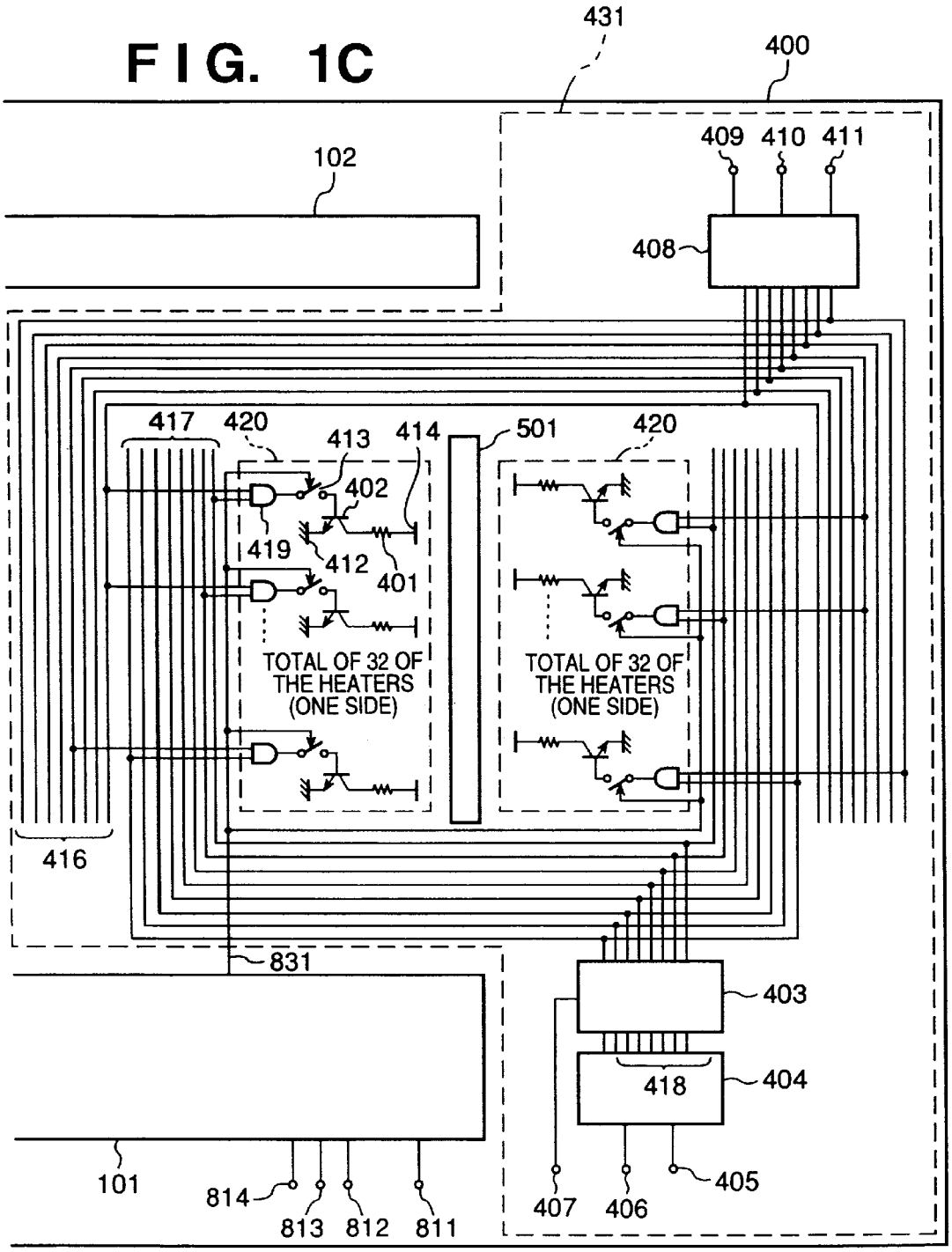
FIG. 1C is a block diagram showing a part B of the circuit arrangement according to the first embodiment in FIG. 1A in detail.

FIG. 1A is a block diagram showing the whole layout of the control circuit which it is formed on the substrate that the inkjet printhead is composed. According to the first embodiment of the present invention, reference numerals 501,502 denote the ink supply holes that penetrated the substrate to supply ink in independence. FIG. 1B is a block diagram showing a part A in FIG. 1A in detail, and FIG. 1C is a block diagram showing a part B in FIG. 1A in detail (to be simply referred to as "FIGS. 1A, 1B, and 1C"). In FIGS. 1A, 1B, and 1C, control systems for discharging inks of two colors are integrally laid out on a single semiconductor substrate 400 which is manufactured as the substrate of 1(one) chip by the semiconductor production process. Reference numerals 101 and 102 denote two signal processing circuit units (a second signal processing circuit) not for selecting an arbitrary heater. In each signal processing circuit, one functional unit is realized by one layout unit. Since divided layout blocks are integrated into one unit, an efficient circuit arrangement can be realized.

Figure 4:
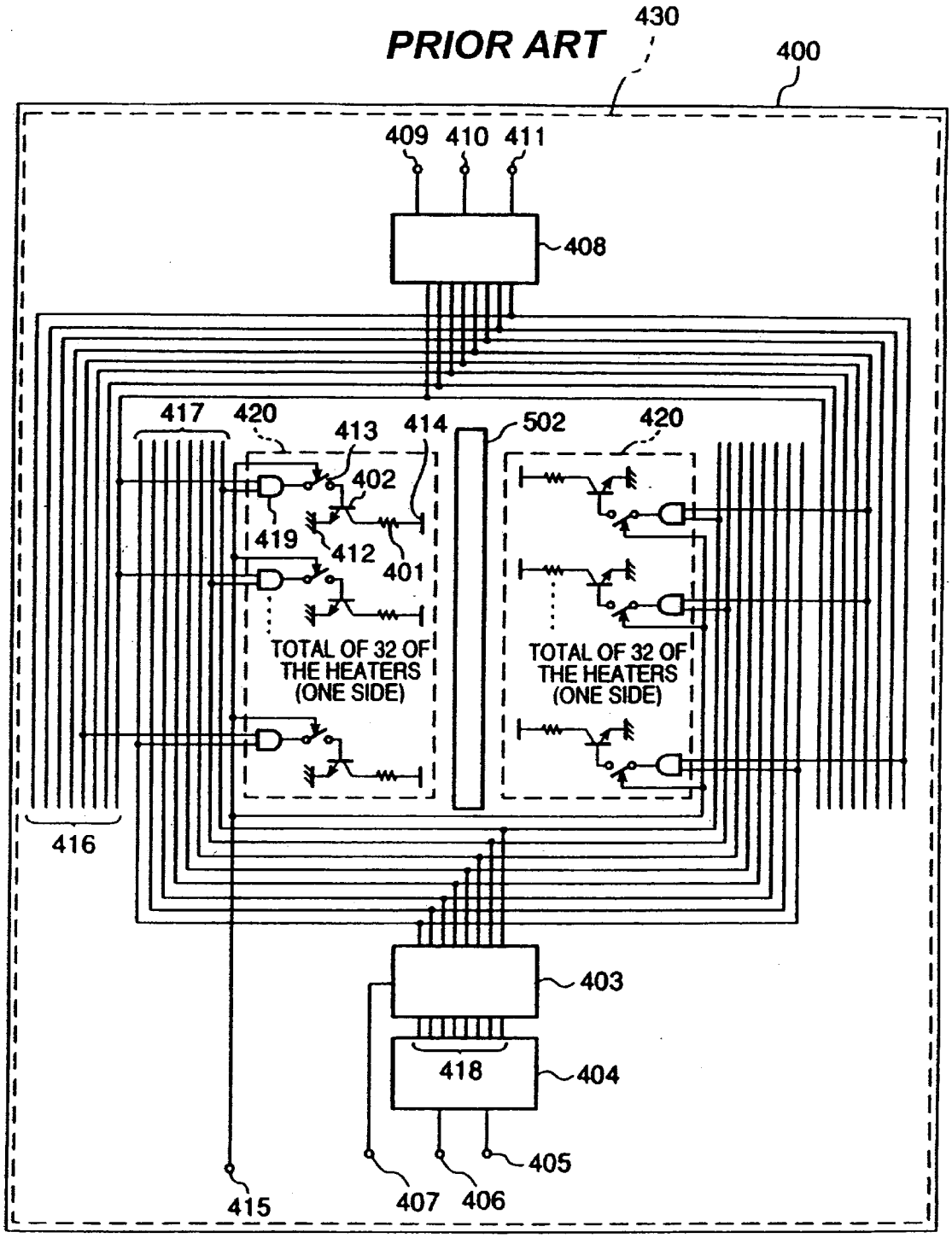
FIG. 4 PRIOR ART
FIG. 4 is a block diagram showing one chip for one color in a conventional block layout.
Figure 5A:
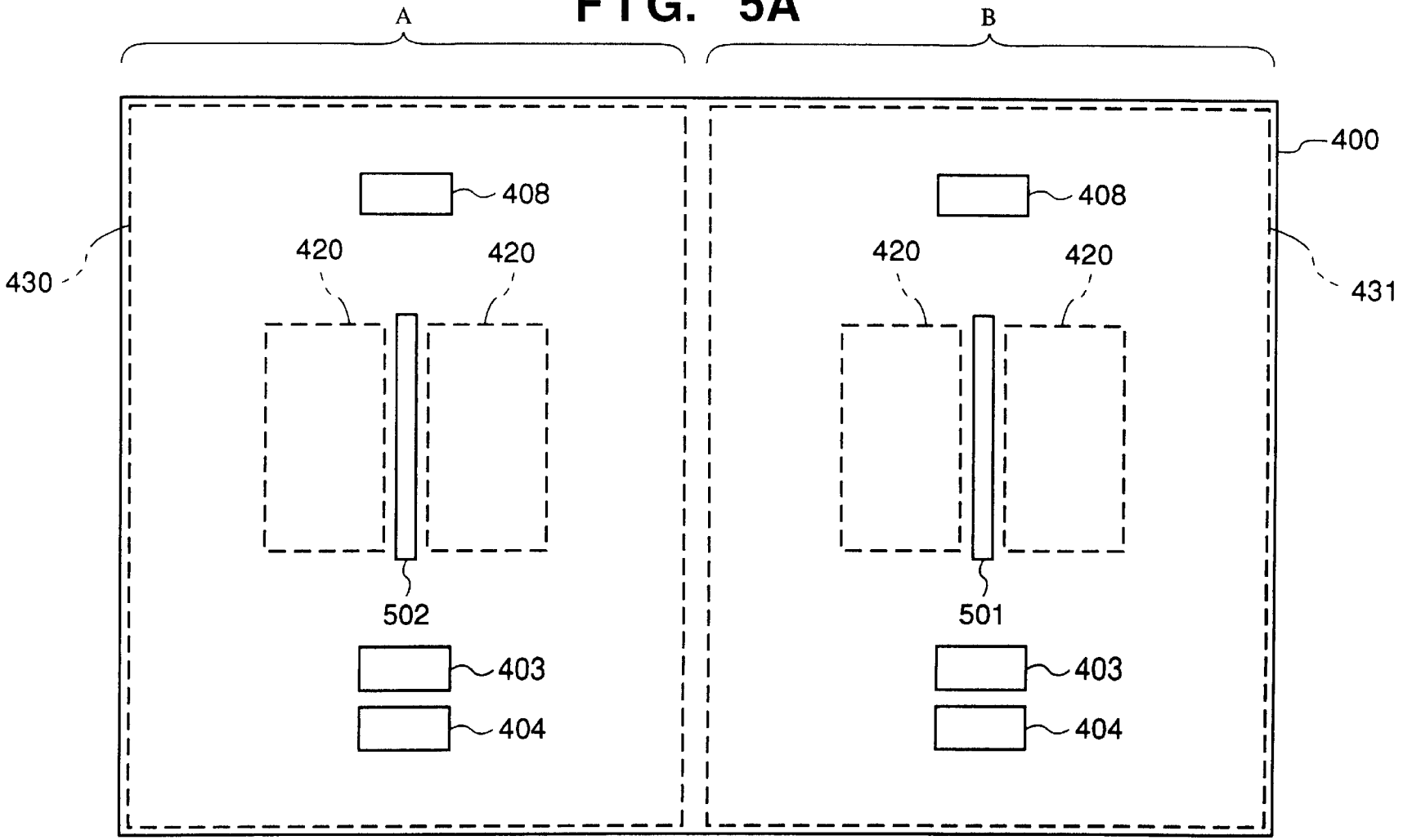
FIG. 5A is a block diagram showing a layout example of one chip for two colors obtained by laying out two arrangements in FIG. 4 side by side into one chip in the whole layout of a circuit that is not publicly disclosed.
Figure 5B:
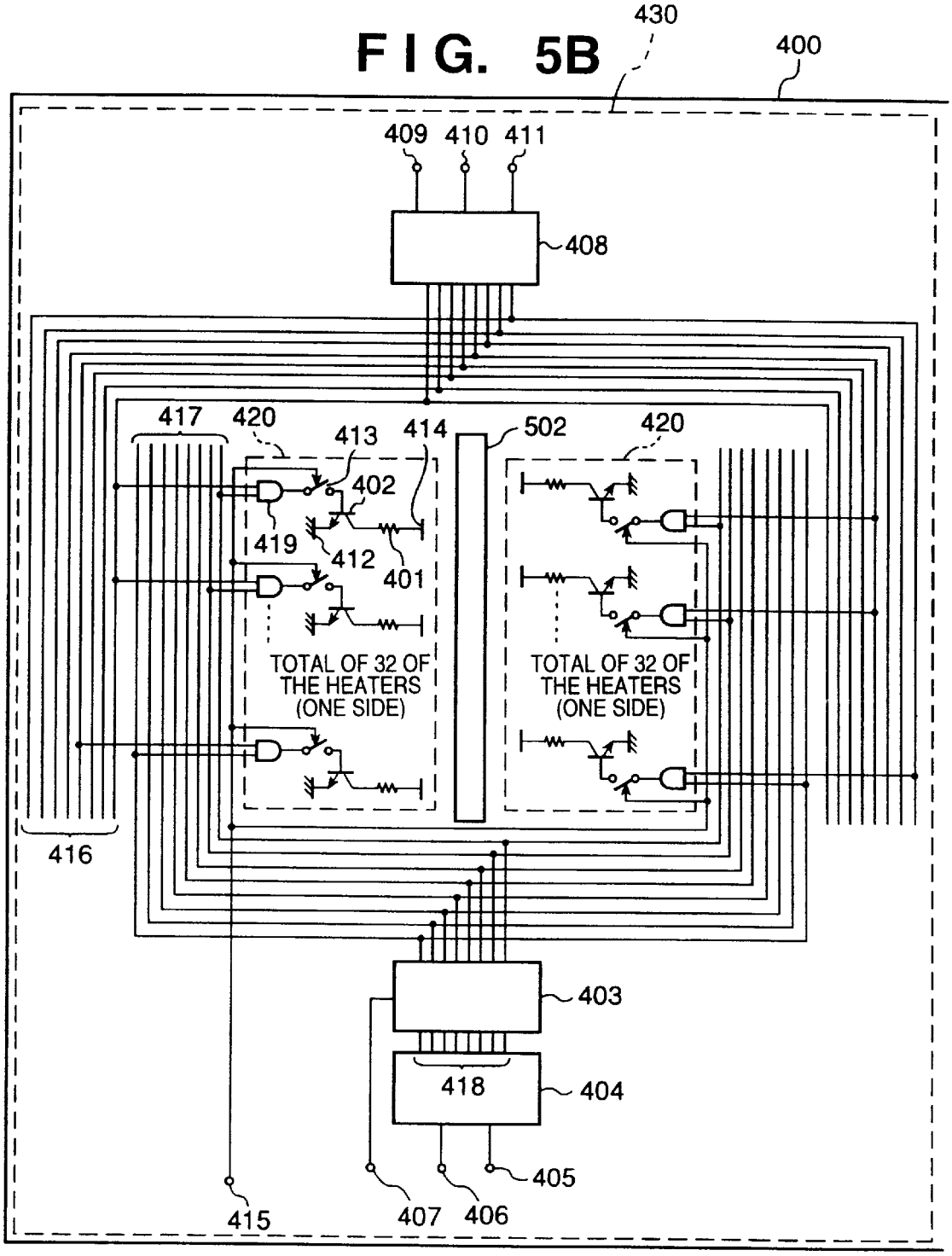
FIG. 5B is a block diagram showing in detail a part A in FIG. 5A showing the whole layout of the circuit that is not publicly disclosed.
Figure 5C:
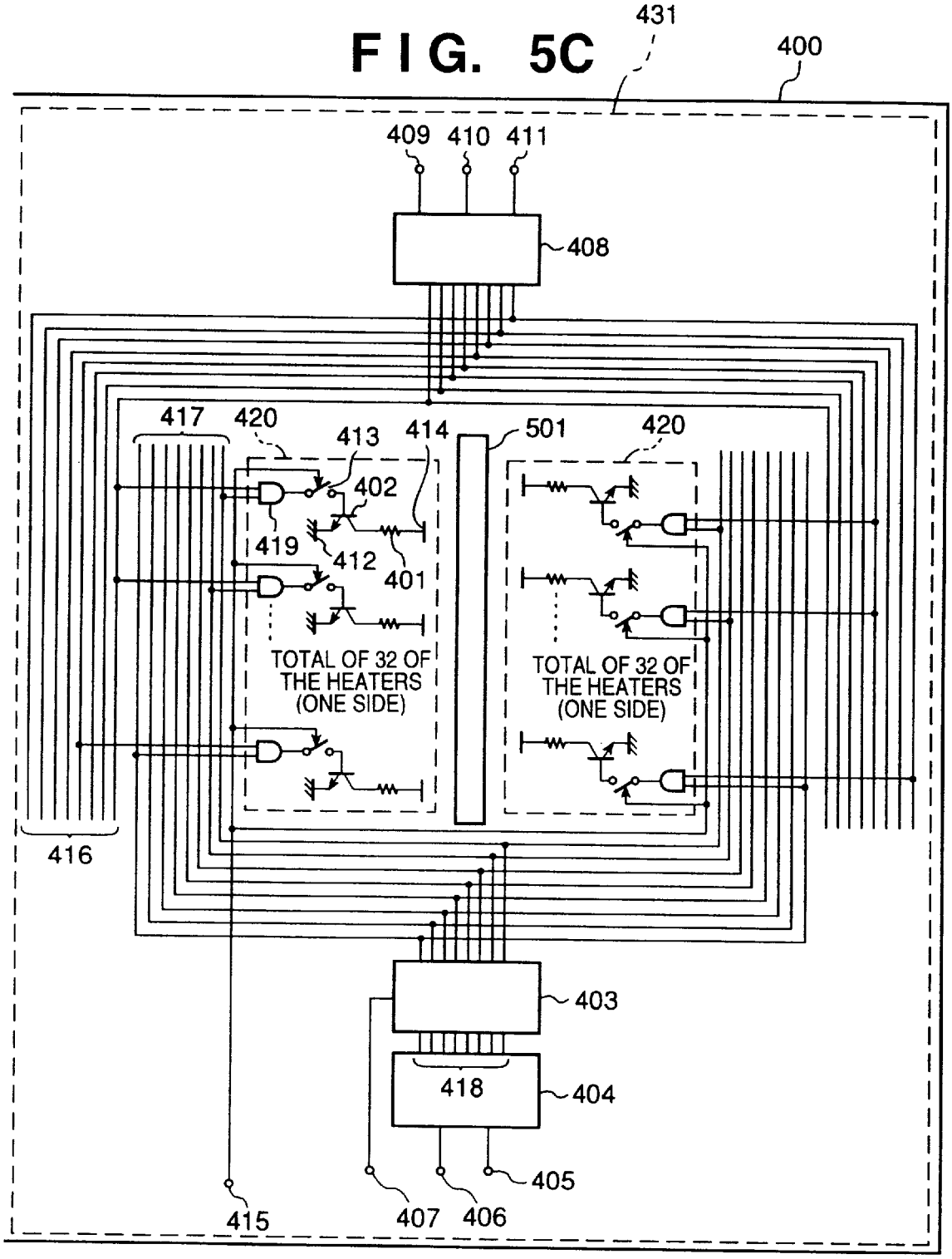
FIG. 5C is a block diagram showing in detail a part B in FIG. 5A showing the whole layout of the circuit that is not publicly disclosed.
Figure 6A:
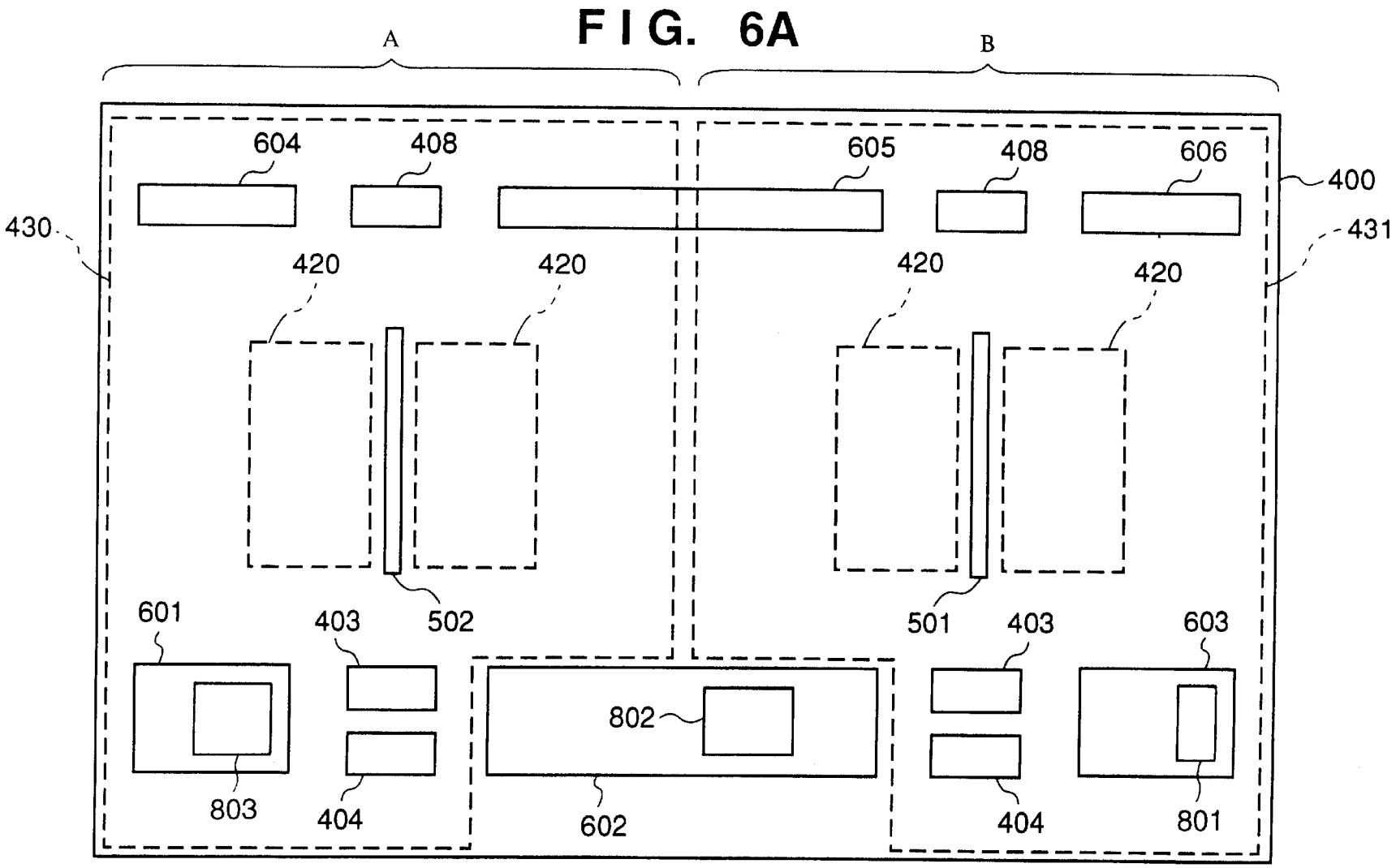
FIG. 6A is a block diagram showing a layout example of one chip for two colors in the whole layout of the second circuit that is not publicly disclosed.
Figure 6B:
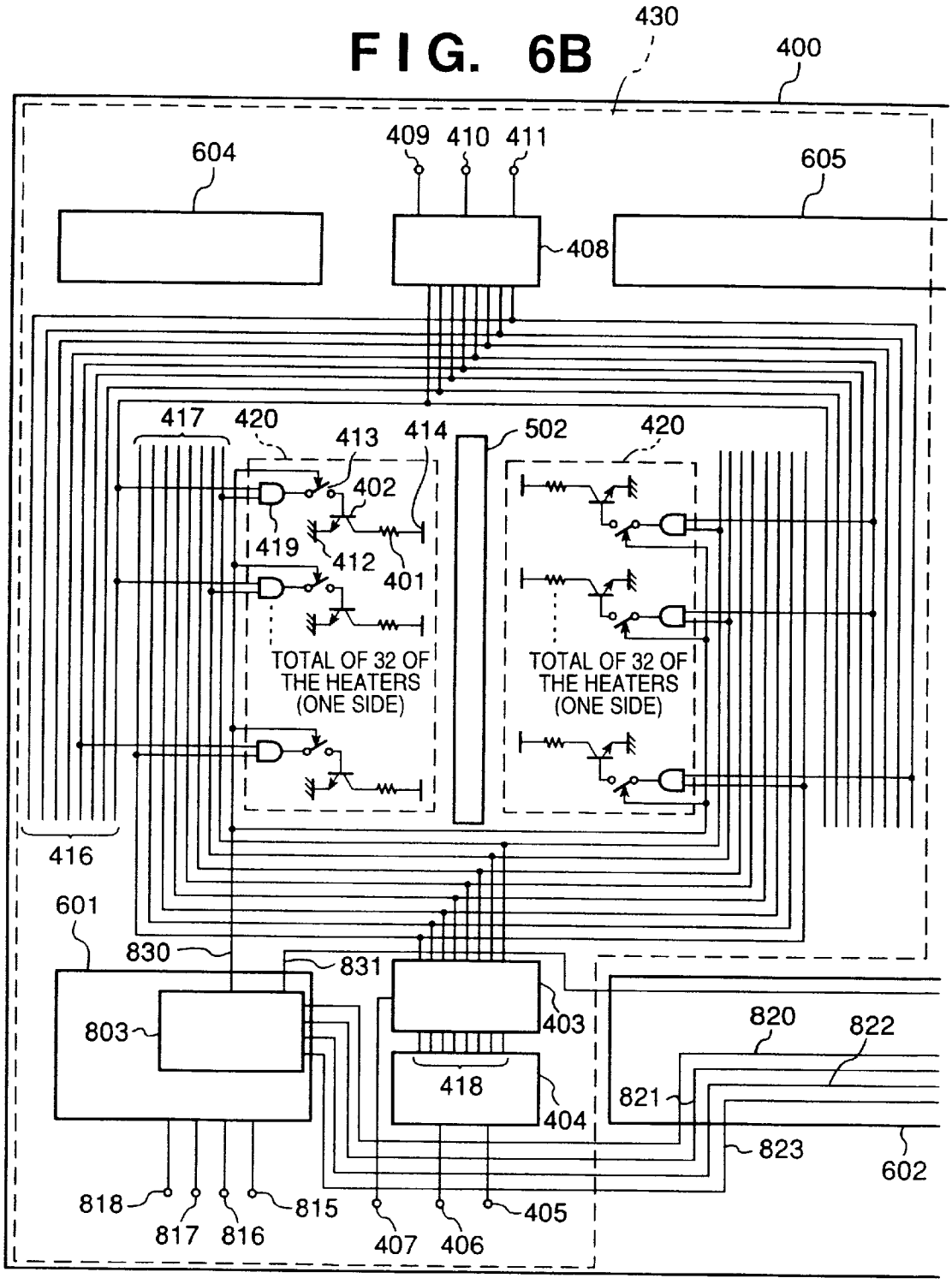
FIG. 6B is a block diagram showing in detail a part A in FIG. 6A showing the whole layout of the second circuit that is not publicly disclosed.
Figure 6C:
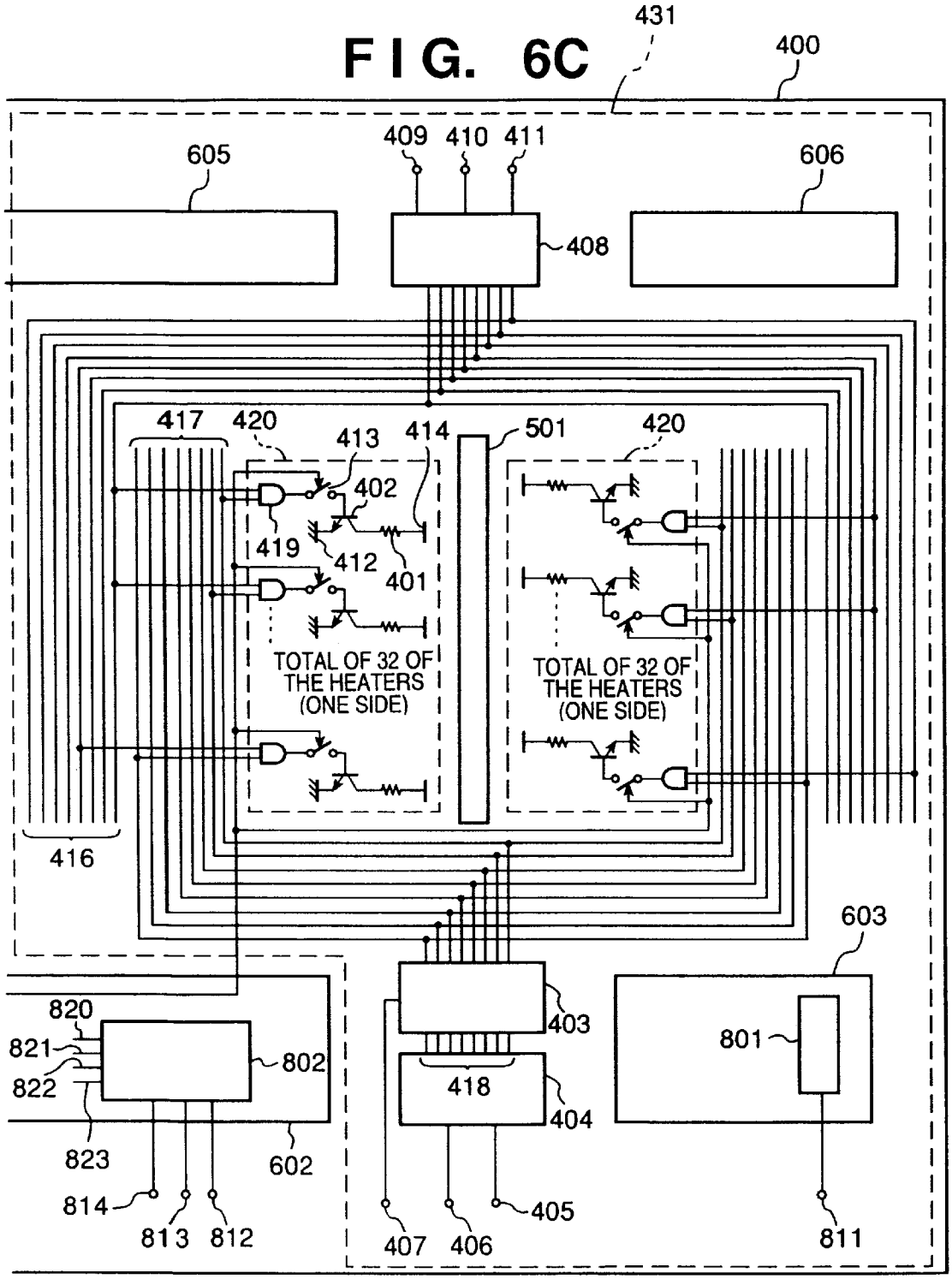
FIG. 6C is a block diagram showing in detail a part B in FIG. 6A showing the whole layout of the second circuit that is not publicly disclosed.
Figure 7:
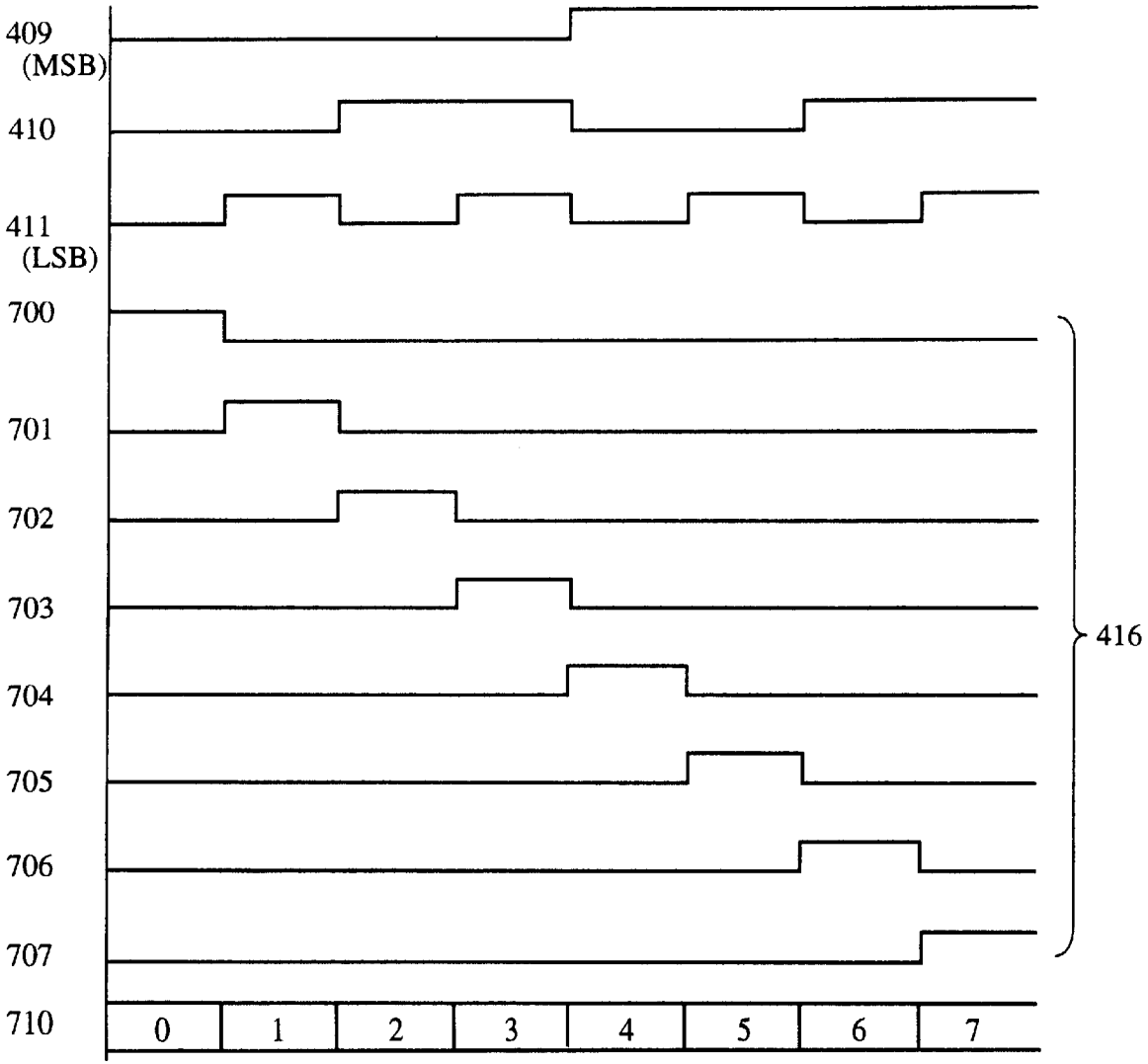
FIG. 7 is a timing chart showing input and output signals to and from a decoder.
Figure 8:
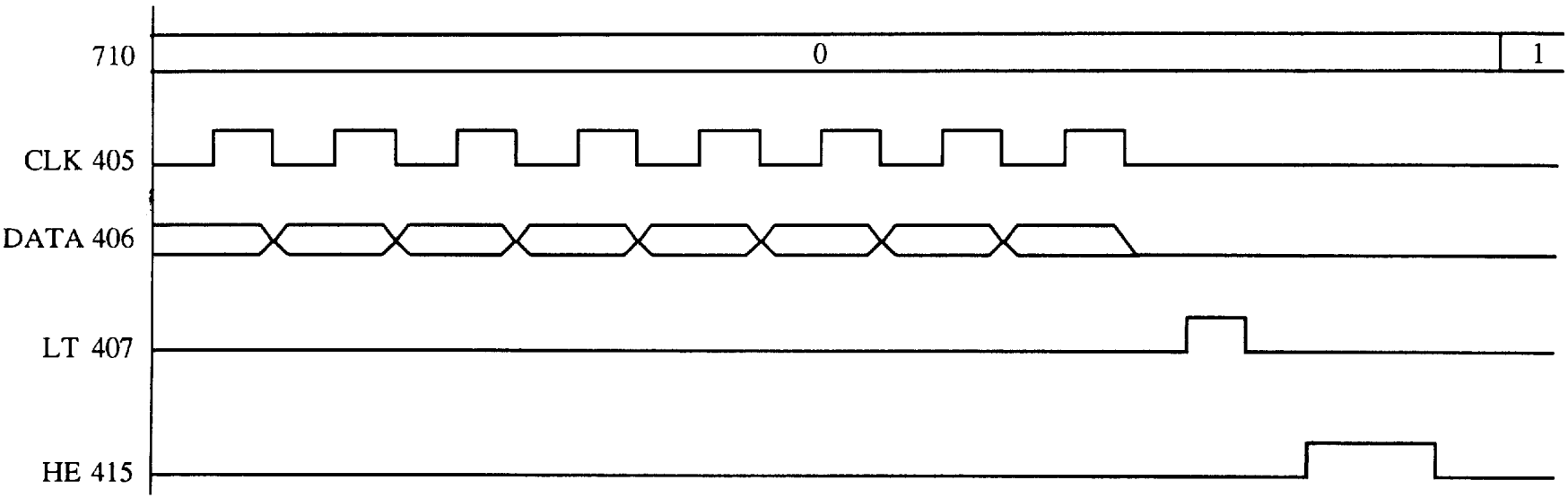
FIG. 8 is a timing chart showing signals at the inputs and outputs of a shift register and latch circuit.

The heater selection circuit unit (a first signal processing circuit), which has been exemplified by the block selection circuit (decoder) 408, shift register 404, and latch circuit 403 (shown in FIG. 4), is arranged at a corner of the semiconductor substrate 400. As for this arrangement, other signal processing circuits do not exist between the heater selection circuit unit and substrate edge. The signal processing circuits 101 and 102, except for an heater selection circuit unit, e.g., heater resistance variation correction circuit units as shown in FIGS. 5A, 5B, and 5C work as a common unit and are arranged, without division in the region (central neighborhood of the substrate) defined by the arbitrary heater selection circuit unit. It is similar even if it is a difficult to arrange a plural ink supply holes in the substrate.

In the circuit arrangement on the substrate of the inkjet printhead according to the first embodiment, the ineffective region of the circuit layout can be reduced to reduce the chip (substrate) size. This can realize a low-cost printhead. In addition, the length of a bypassed signal line susceptible to disturbance can be minimized to realize a printhead free from any malfunction.

Since elements which compose the signal processing circuit are arranged in the second signal processing circuit unit, the distance between the elements can be shortened, and the temperature difference between the elements, and process variations can be reduced. Element operating points and relative precision levels can be respectively made equal within the block, and a printhead having excellent characteristics can be realized.

In this case, blocks 430 and 431 may have different numbers of heaters in order to optimize the relationship between the recording (printing) quality, recording (printing) speed, and cost. Moreover, in the case where the ink that is supplied from ink supply hole 501,502 is same, the blocks 430 and 431 may separately control ink of the same color without departing from the gist of the present invention.

The signal processing circuits 101 and 102, except for heater selection circuit unit, may include various circuits in addition to the circuit which is explained previously for correcting manufacturing variations in heater. For example, a temperature sensor may be formed on a semiconductor substrate, may predict characteristics which change in accordance with the chip temperature, e.g., the ink viscosity, the ON resistance of a power transistor 402, or the resistance of a heater 401, and may change the pulse width of a HEAT signal 15 or the voltage of a power supply 414 to correct the ink discharge amount. A temperature sensor may similarly be formed and may forcibly stop circuit operation upon overheat (thermal runaway). A circuit for detecting the type or characteristics of ink may be formed. For example, an element may be attached to the ink tank to identify it and be connected to the printhead, and the head or printer main body may read the element information of the ink tank to drive a heater corresponding to the type or characteristics of ink. Also, a circuit for detecting the residual ink amount may be formed. For example, since ink is normally a conductor containing water as a solvent, two electrodes may be formed on a semiconductor substrate and dipped in the ink, and the resistance between the two electrodes may be checked to detect the residual ink amount (presence/absence of ink). Further, a circuit for storing the discharge count and, when the discharge count reaches a predetermined count, generating a signal to change the printhead may be formed. These circuit units can also attain the same effects of the present invention by the functions of the signal processing circuits 101 and 102, except for selecting and driving a heater.

[Second Embodiment]

Figure 2A:
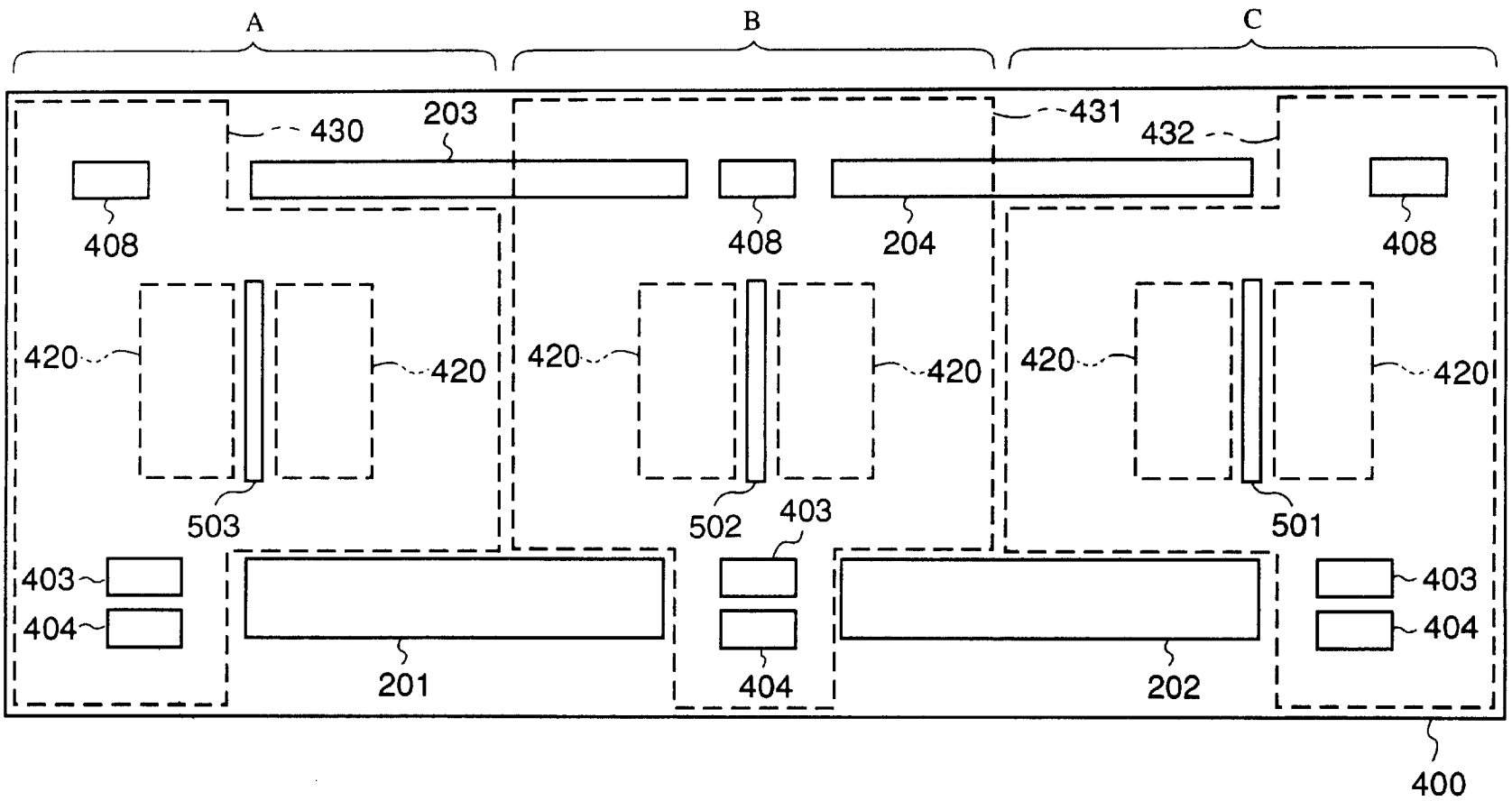
FIG. 2A is a block diagram showing the whole circuit arrangement according to the second embodiment.
Figure 2B:
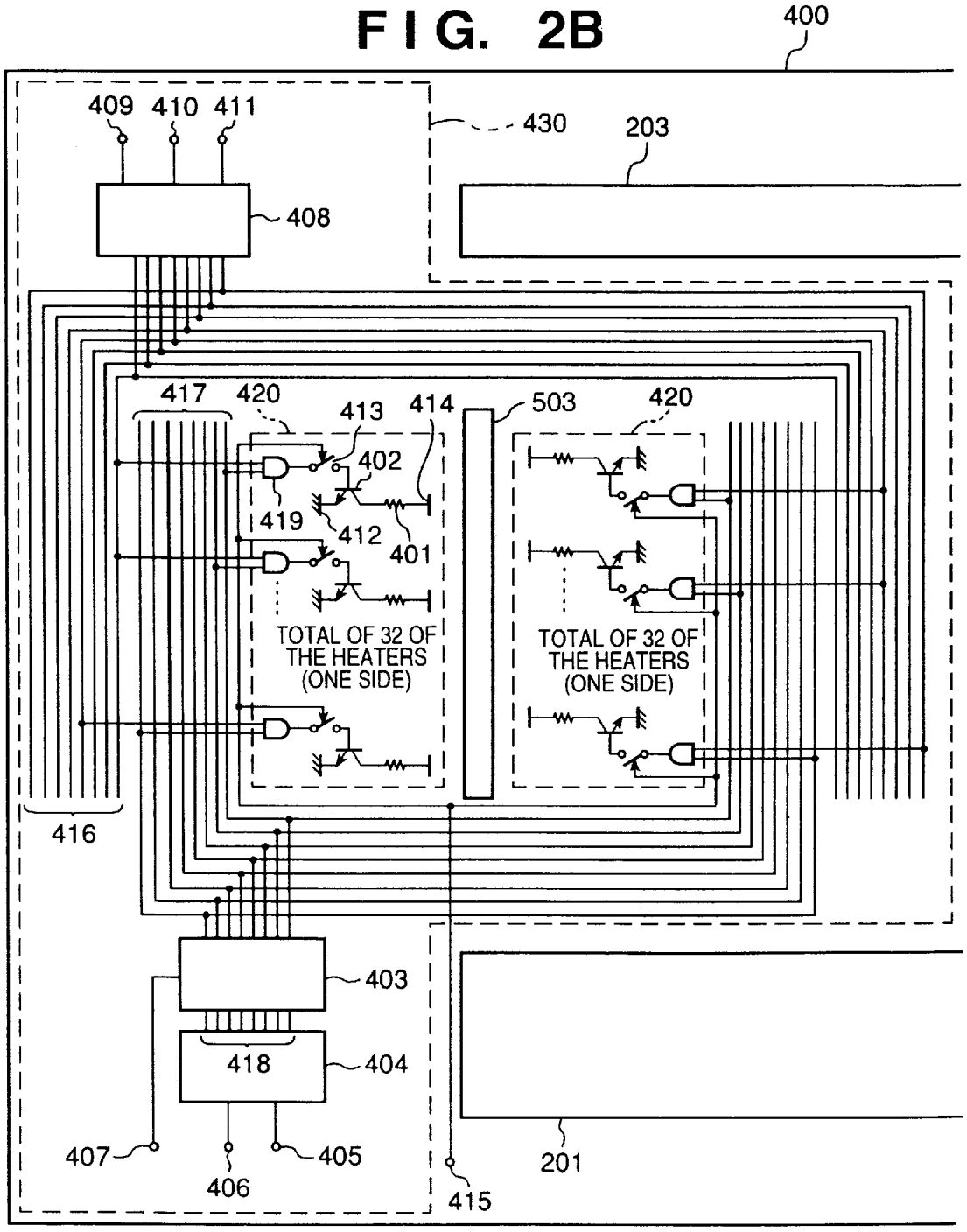
FIG. 2B is a block diagram showing a part A of the circuit arrangement according to the second embodiment in FIG. 2A in detail.
Figure 2C:
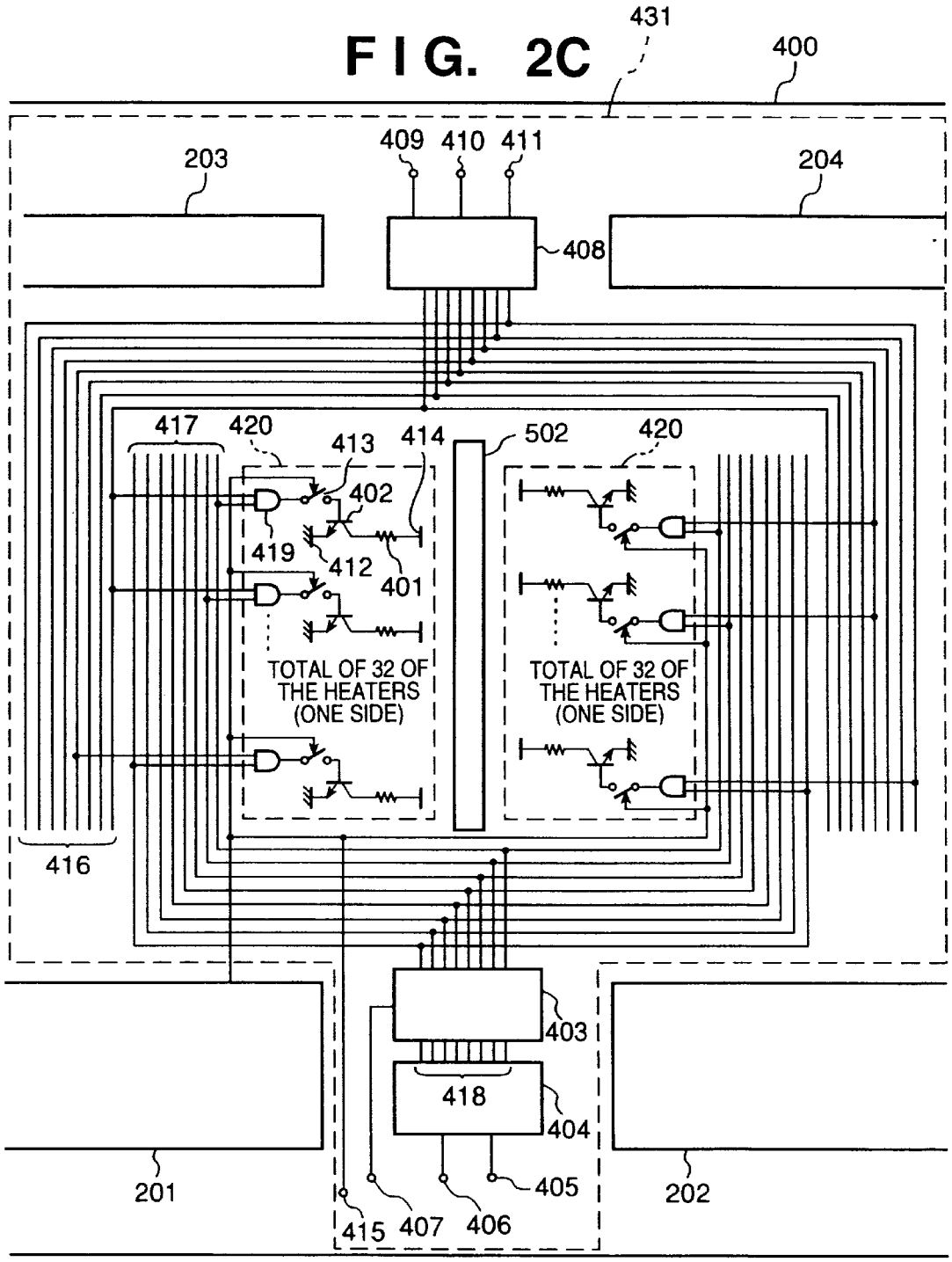
FIG. 2C is a block diagram showing a part B of the circuit arrangement according to the second embodiment in FIG. 2A in detail.
Figure 2D:
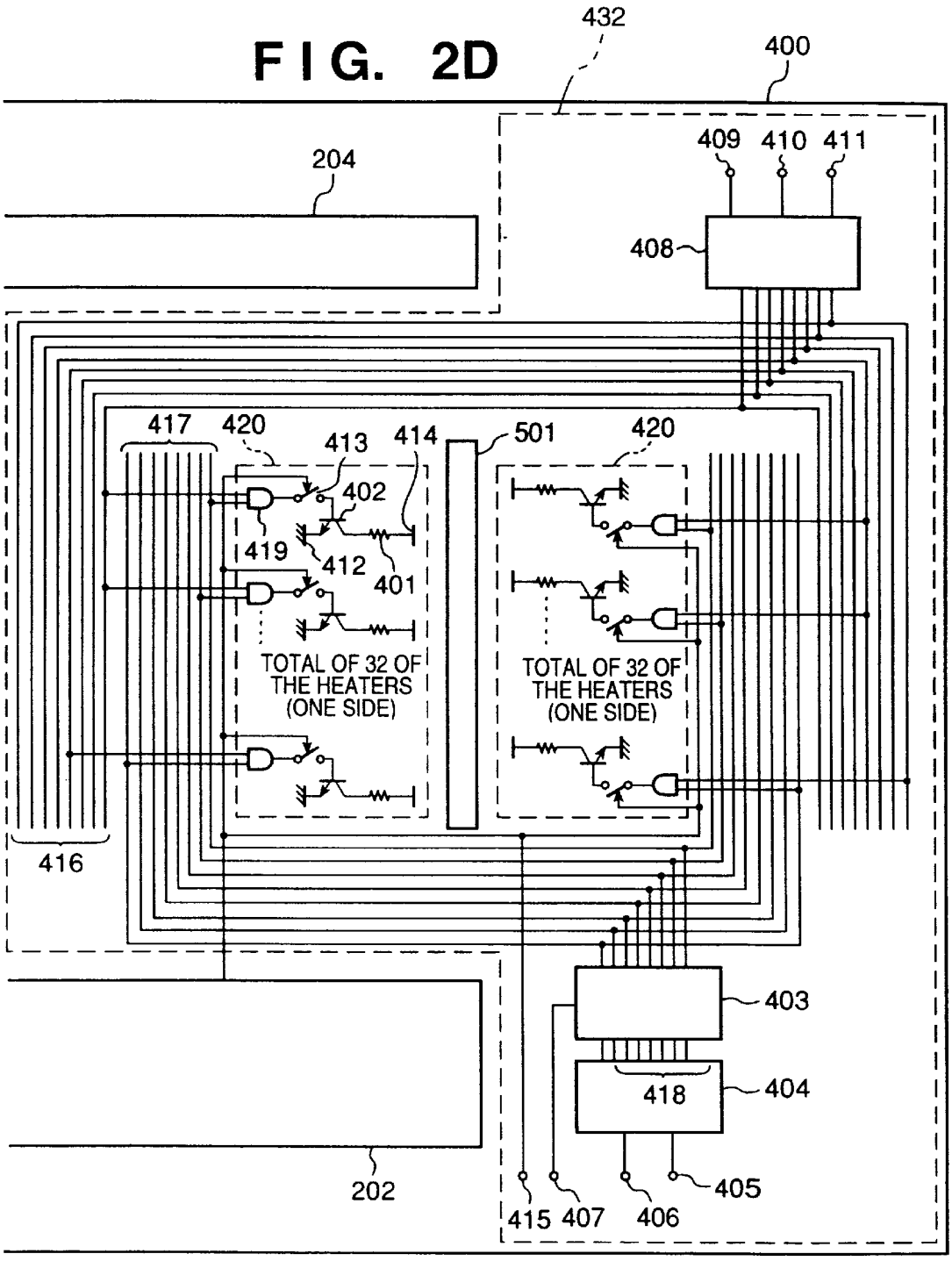
FIG. 2D is a block diagram showing a part C of the circuit arrangement according to the second embodiment in FIG. 2A in detail.
Figure 3:
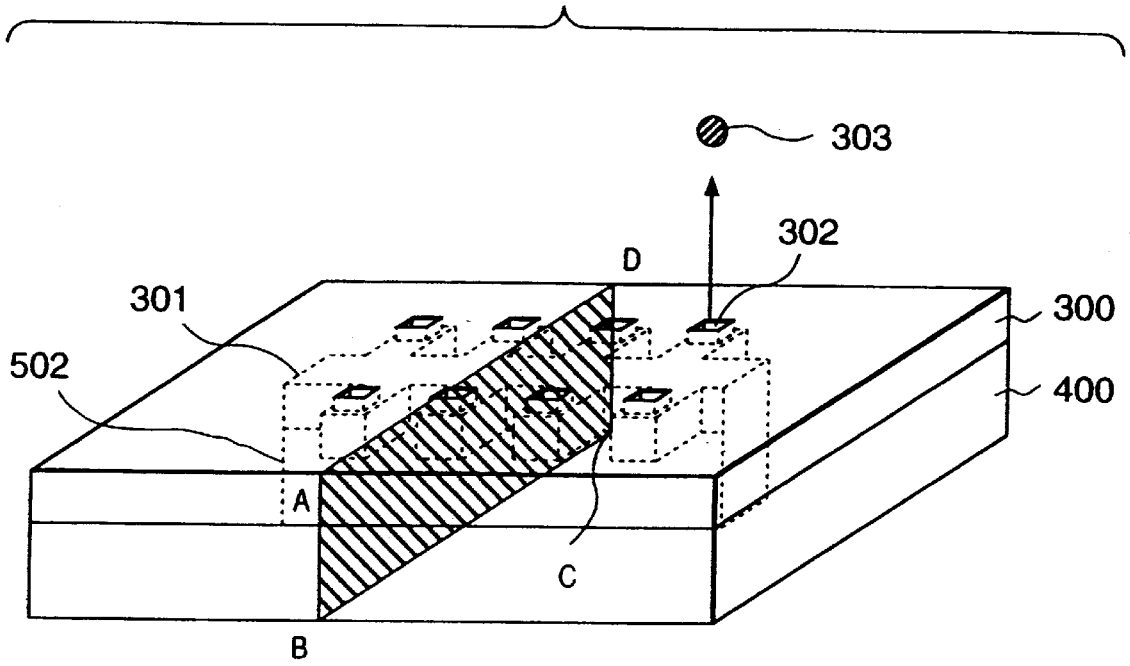
FIG. 3 PRIOR ART
FIG. 3 is a perspective view showing one chip for one color in a conventional arrangement.
Figure 3:
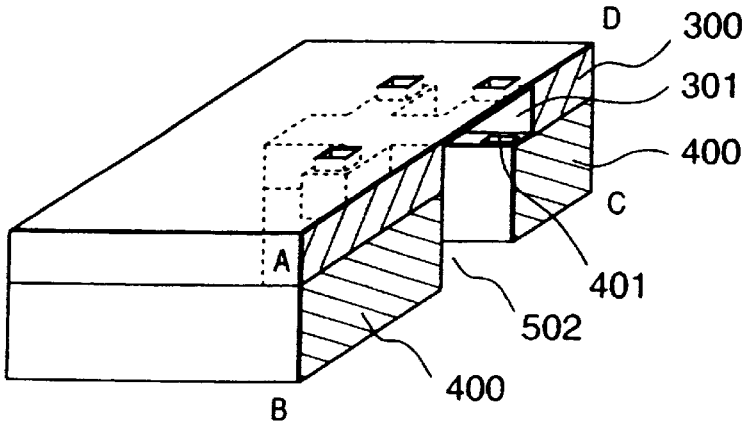
FIG. 3 PRIOR ART

FIG. 2A is a block diagram showing the whole layout of a circuit arrangement of the substrate that composes the inkjet printhead according to the second embodiment of the present invention, the substrate that has 3 ink supply holes is being shown. FIG. 2B is a block diagram showing a part A in FIG. 2A in detail, FIG. 2C is a block diagram showing a part B in FIG. 2A in detail, and FIG. 2D is a block diagram showing a part C in FIG. 2A in detail (to be simply referred to as "FIGS. 2A, 2B, 2C, and 2D").

An embodiment when control systems for driving circuit which discharges the inks of three colors are integrally laid out on a single semiconductor substrate 400 will be described with reference to FIGS. 2A, 2B, 2C, and 2D. Reference numerals 430, 431, and 432 denote selection circuit units each including a circuit necessary for one type of ink, which is supplied from each of the ink supply holes 501, 502, 503, is discharged by driving the heater that is selected arbitrarily.

Reference numerals 201, 202, 203, and 204 denote signal processing circuits for performing functions except for selecting a heater selection circuit unit, which are arranged in a region between heater selection circuit units. The heater selection circuit units for controlling discharge the inks of colors at the two ends of the semiconductor substrate are laid out at corners of the semiconductor substrate in order to ensure a wide region for laying out signal processing circuits other than these heater selection circuit units. A heater selection circuit unit for controlling a color at the center is desirably arranged at the center of the chip as much as possible. However, this circuit may be shifted from the center in accordance with the sizes of the signal processing circuits 201, 202, 203, and 204 other than the heater selection circuit unit.

With this layout, even when the control systems for inks of three colors are integrally laid out on one chip (substrate), the ineffective region can be reduced to reduce the chip size, and a low-cost printhead can be realized. In addition, the length of a bypassed signal line susceptible to disturbance can be minimized to realize a printhead free from any malfunction. By shortening the distance between elements within the same signal processing circuit, the temperature difference and process variations can be reduced, element operating points can coincide with each other within the block, and a printhead having excellent characteristics can be realized.

Even when control systems for inks of four colors or more are integrally laid out on one chip, the same effects can be obtained by laying out arbitrary heater selection circuit units for controlling discharge the inks of colors at the two ends of a semiconductor substrate at corners of the semiconductor substrate.

Figure 11:
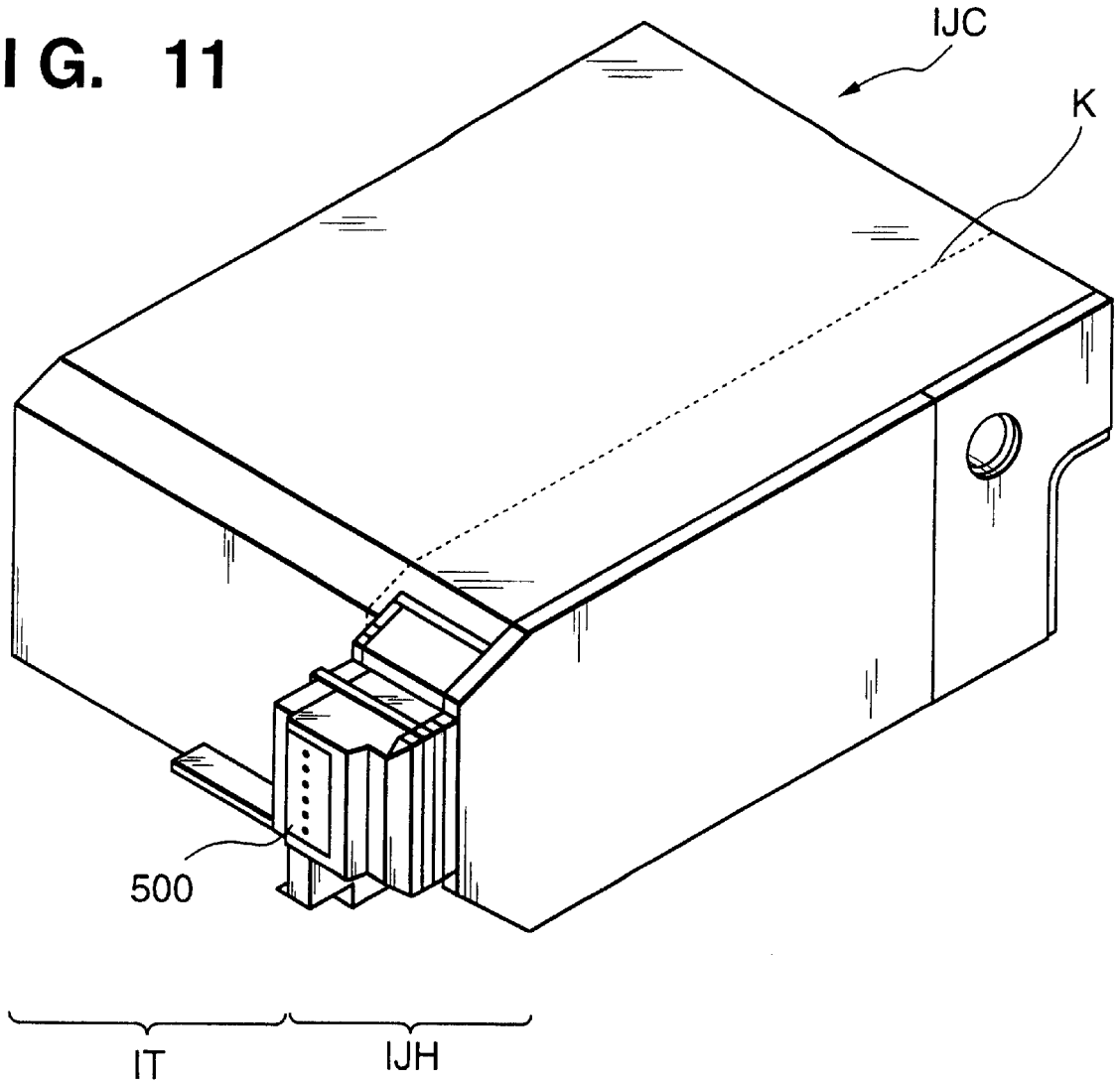
FIG. 11 is a perspective view showing the outer appearance of an ink cartridge IJC which can be disassembled into an ink tank and head.

FIG. 11 is a perspective view showing the outer appearance of an ink cartridge IJC which can be disassembled into an ink tank and head. As shown in FIG. 11, the ink cartridge IJC can be disassembled into an ink tank IT and printhead IJH at a boundary line K. The ink cartridge IJC has an electrode (not shown) for receiving an electrical signal from a carriage HC when the ink cartridge IJC is mounted on the carriage HC. The ink cartridge IJC is driven by the electrical signal to discharge ink, as described above.

In FIG. 11, reference numeral 500 denotes an ink orifice array. The ink tank IT has a fibro or porous ink absorber in order to hold ink, and the ink absorber holds ink.

In the above embodiments, ink is discharged from the printhead in the form of droplets, and the fluid contained in the ink tank is ink. However, the contained fluid is not limited to ink. For example, the ink tank may contain a processing solution discharged to a printing medium in order to enhance the fixation and water resistance of a printed image or improve the image quality.

The above embodiments comprise a means (e.g., an electrothermal converter or laser beam) for generating heat energy used to discharge ink, and uses a method of changing the state of ink by the heat energy, among various inkjet printing methods. Accordingly, a high-density, high-definition image can be printed.

As for the typical structure and principle, it is preferable to employ the basic principle disclosed in, for example, U.S. Pat. Nos. 4,723,129 or 4,740,796. The above method can be adapted to both a so-called on-demand type apparatus and a continuous type apparatus. In particular, a satisfactory effect can be obtained when the on-demand type apparatus is employed because of the structure arranged in such a manner that at least one drive signal, which rapidly raises the temperature of an electrothermal converter disposed to face a sheet or fluid passage which holds the fluid (ink) to a level higher than levels at which film boiling takes place are applied to the electrothermal converter in accordance with printing information so as to generate heat energy in the electrothermal converter and to cause the heat effecting surf ace of the printhead to take place film boiling so that bubbles can be formed in the fluid (ink) to correspond to the one or more drive signals. The enlargement/contraction of the bubble will cause the fluid (ink) to be discharged through a discharge opening so that at least one droplet is formed. If a pulse drive signal is employed, the bubble can be enlarged/contracted immediately and properly, causing a further preferred effect to be obtained because the fluid (ink) can be discharged while revealing excellent response.

It is preferable to employ a pulse drive signal disclosed in U.S. Pat. Nos. 4,463,359 or 4,345,262. If conditions disclosed in U.S. Pat. No. 4,313,124 which is an invention relating to the temperature rise ratio at the heat effecting surface are employed, a satisfactory printing result can be obtained.

In addition, the invention is effective for a printhead of a freely exchangeable chip type which enables electrical connection to the apparatus main body or supply of ink from the apparatus main body by being mounted onto the apparatus main body, or for the case by use of a printhead of the cartridge type provided integrally on the printhead itself.

It is preferred to additionally employ a printhead recovery means and auxiliary means provided as a component of the present invent because printing operation can be further stabilized thereby. Specifically, it is preferable to employ a printhead capping means, cleaning means, pressurizing or suction means, electrothermal converter, another heating element or a sub-heating means constituted by combining them and a sub-discharge mode in which ink is discharged independently of the printing operation in order to stabilize the printing operation.

Further, the printing mode of the printing apparatus is not limited to a printing mode using only a major color such as black, but may include at least one of a printing mode using a plurality of different colors or a printing mode using full colors by color mixing, which can be implemented by integrating printheads or combining a plurality of printheads.

Although a fluid ink is employed in the above embodiments, an ink which is solidified at room temperature or lower, or an ink which is softened or liquefied at room temperature may be used. That is, any ink which is liquefied when a printing signal is supplied may be used because a general inkjet apparatus adjusts the temperature of the ink itself within the range of 30° C. or more to 70° C. or less to control the temperature so as to make the viscosity of the ink fall within a stable discharge range.

Furthermore, an ink which is solidified when it is caused to stand, and liquefied when heat energy is supplied can be adapted to positively prevent a temperature rise caused by heat energy by utilizing the temperature rise as energy of state transition from the solid state to the liquid state or to prevent ink evaporation. In any case, ink which is liquefied when heat energy is supplied in accordance with a printing signal so as to be discharged in the form of fluid ink, or ink which is liquefied only after heat energy is supplied, e.g., ink which starts to solidify when it reaches a printing medium, can be adapted to the present invention. It is the most preferred way for the ink to be discharged is to adapt the above film boiling method.

The printing apparatus according to the present invention may take the form of a copying machine combined with a reader and the like, or the form of a facsimile apparatus having a transmission/reception function, in addition to the form of an image output terminal integrally with or separately from an information processing device such as a computer.

The present invention may be applied to a system constituted by a plurality of devices (e.g., a host computer, interface device, reader, and printer) or an apparatus comprising a single device (e.g., a copying machine or facsimile apparatus).

As has been described above, according to the present invention, since a circuit for arbitrarily selecting a heater is laid out at the corner of a semiconductor substrate, a signal processing circuit block other than the circuit for selecting an arbitrary heater need not be divisionally laid out, the ineffective region can be reduced to reduce the chip size, and a low-cost printhead can be realized. The length of a bypass signal line susceptible to disturbance can be minimized to realize a printhead free from any malfunction. By shortening the distance between elements within the same signal processing circuit, the temperature difference and process variations can be reduced, element operating points can coincide with each other within the block, and a printhead having excellent characteristics can be realized.

The present invention is not limited to the above embodiments and various changes and modifications can be made within the spirit and scope of the present invention. Therefore, to appraise the public of the scope of the present invention, the following claims are made.

What is claimed is:

1. An inkjet printhead for discharging ink and implementing a recording, comprising a substrate as an element, said substrate having:

a plurality of ink supply holes for passing discharge ink;

a plurality of heaters arranged in a vicinity of said ink supply holes for discharging ink that is supplied from said ink supply holes by heating;

a first signal processing circuit laid out at least at one corner of said substrate to select and drive said heaters; and a second signal processing circuit other than said first signal processing circuit to select and drive said heaters.

2. The printhead according to claim 1, wherein said second signal processing circuit has a control circuit arrangement laid out in a region which is interposed between said first signal processing circuit or adjacent to said first signal processing circuit.

3. The printhead according to claim 1, wherein said first signal processing circuit is made up of a shift register circuit and latch circuit.

4. The printhead according to claim 1, wherein said first signal processing circuit includes a decoder circuit.

5. The printhead according to claim 1, wherein said first signal processing circuit includes a buffer circuit.

6. The printhead according to claim 1, wherein said first signal processing circuit has a connection terminal or protection circuit outside said first signal processing circuit.

7. The printhead according to claim 1, wherein a signal processing circuit is laid out inside said first signal processing circuit.

8. The printhead according to claim 1, wherein said second signal processing circuit detects manufacturing variations.

9. The printhead according to claim 1, wherein said second signal processing circuit predicts or detects a temperature of said printhead or a printing apparatus.

10. The printhead according to claim 1, wherein said second signal processing circuit predicts or detects the type of ink or characteristics of ink.

11. The printhead according to claim 1, wherein said second signal processing circuit predicts or detects a residual ink amount.

12. The printhead according to claim 1, wherein said second signal processing circuit predicts or detects exchange time of said printhead.

13. A printing apparatus comprising:

an inkjet printhead according to claim 1;

a carriage to install said inkjet printhead.

14. A substrate for an inkjet printhead comprising:

a plurality of ink supply holes for passing discharged ink;

a plurality of heaters arranged in a vicinity of said ink supply holes for discharging ink that is supplied from said ink supply holes by heating;

a first signal processing circuit laid out at least at one corner of said substrate to arbitrarily select and drive said heaters; and a second signal processing circuit other than said first signal processing circuit to arbitrarily select and drive said heaters, wherein said second signal processing circuit has a control circuit arrangement laid out in a region which is interposed between said first signal processing circuit or adjacent to said first signal processing circuit.

* * * * *